US005699622A

United States Patent [19]

Umbro

[11] Patent Number: 5,699,622

[45] Date of Patent: Dec. 23, 1997

[54] LINE MARKING DEVICE

[76] Inventor: Gerald G. Umbro, 14 Somers Dr., Rhinebeck, N.Y. 12572

[21] Appl. No.: 501,481

[22] Filed: Jul. 12, 1995

[51] Int. Cl.[6] ..... B44D 3/38

[52] U.S. Cl. ..... 33/414; 33/339

[58] Field of Search ..... 33/413, 414, 339, 33/32.1

[56] References Cited

U.S. PATENT DOCUMENTS

| | | | |
|---|---|---|---|
| 577,708 | 2/1897 | Barrie | 33/413 |
| 683,115 | 9/1901 | Gilliom | 33/413 |
| 754,157 | 3/1904 | McCormick | 33/414 |
| 921,302 | 5/1909 | Starr | 33/414 |
| 1,545,327 | 7/1925 | Hobson | 33/414 |
| 2,524,596 | 10/1950 | Kamp | 33/413 |
| 2,606,371 | 8/1952 | Klimek . | |
| 2,655,728 | 10/1953 | Cook | 33/414 |
| 3,475,822 | 11/1969 | De Lain | 33/414 |
| 4,143,462 | 3/1979 | Gertz . | |
| 4,189,844 | 2/1980 | Riggins, Sr. . | |
| 4,312,133 | 1/1982 | Mima . | |
| 4,551,922 | 11/1985 | Someya | 33/414 |
| 5,375,334 | 12/1994 | Coker | 33/414 |

*Primary Examiner*—Thomas B. Will

*Attorney, Agent, or Firm*—Ostrolenk, Faber, Gerb & Soffen, LLP

[57] ABSTRACT

A line marking device includes an elongated body which mounts a marking filament that is loaded with marking powder. When the filament is snapped against a surface a portion of the powder is deposited on that surface along a well defined line. The body also mounts a protractor and spirit levels that are used to locate or set the device in a predetermined position prior to snapping the marking filament against the surface to be marked. The marking filament extends through a shuttle chamber that contains a supply of marking powder. That shuttle is moved back and forth on the body to recharge the marking filament with marking powder. In a second embodiment of this invention the marking filament is pressed rather than snapped against the surface to be marked. In a third embodiment of this invention a writing instrument mounted on the body of the device is drawn along the length of the body to draw a line on a receiving surface adjacent the body. The writing instrument is moved by a puller filament that is windable about a spring loaded take-up reel. A holding detent of a ratchet normally acts to isolate the puller filament from operating forces that move the writing instrument.

17 Claims, 4 Drawing Sheets

10
14
15
16
18
20
25
26
27
28
30
35
36
37
38
39
43
44
45
46
47
48
49
52
58
59
65
69
91
98
99
F

LINE MARKING DEVICE

BACKGROUND OF THE INVENTION

This invention relates to devices for marking straight lines on flat surfaces and relates more particularly to improvements in so-called chalk line marking devices.

Chalk line marking devices are used extensively in the construction field for marking straight lines on walls. These devices utilize a line, constituted by a string that is coated or impregnated with chalk, for marking by placing the chalked line in a desired orientation and then snapping the line against the surface to be marked.

Some examples of chalk line marking devices are disclosed in U.S. Pat. No. 4,143,462 issued Mar. 13, 1979 to A. R. Gertz for a Chalk Line Device, U.S. Pat. No. 4,189,844 issued Feb. 26, 1980 to R. J. Riggins, Sr. for a Chalk Line Protracting Tool and U.S. Pat. No. 4,551,922 issued Nov. 12, 1985 to Y. Someya for a Line Marking Device. The devices disclosed in the aforesaid U.S. patents, as well as other prior art devices of this type, are relatively expensive and/or complicated to construct and/or utilize.

SUMMARY OF THE INVENTION

In accordance with teachings of the instant invention, line marking devices are provided for marking lines on boards as well as on surfaces (i.e. vertical walls) that do not have conveniently located edges which can be used for alignment or base line measurement purposes. Devices according to the instant invention are usable conveniently by one person in that such devices include a marking string or chalk line that is anchored at both ends to an elongated body. The marking string extends through a shuttle that carries a supply of powdered chalk and is mounted to be moved back and forth along the length of the elongated body to apply chalk to the marking string. With the shuttle parked in its home position at one end of the main body, a spring attached to the body biases the shuttle rearward against the front surface of the body.

For marking of a line on a receiving surface, the rear surface of the main body is seated against the receiving surface and a force is applied to the shuttle to tilt same forward and by so doing the marking string is drawn forward. Upon release of the shuttle it is snapped rearward by the spring and at the same time substantially the entire length of the string snaps rearward into engagement with the receiving surface to mark same with a line indicated by chalk that is deposited on the receiving surface. During the line marking operation the operator holds the marking device by a handle that is positioned in the vicinity of the biasing spring. The force for tilting the shuttle forward is applied to the latter by a finger of the operator's hand that is grasping the handle.

Positioning of the chalk line prior to snapping same against the receiving surface is achieved by utilizing spirit levels that are mounted on the main body or by utilizing a protractor that is mounted at the end of the main body which contains the biasing spring for the shuttle. The transverse arm of the protractor is set against the edge of a board containing the receiving surface that is to be marked. The protractor is removable so that the marking device may be utilized for marking a wall or other surface that does not have a conveniently located edge against which to abut the cross arm of a protractor. Without a protractor secured to the elongated body, the latter is positioned by utilizing a spirit level mounted thereon.

Accordingly, the primary object of the instant invention is to provide an improved line marking device that is relatively inexpensive to construct and/or convenient to utilize.

Another object is to provide a so-called chalk line marking device that is convenient for use by one individual.

A further object is to provide a novel device that is convenient for marking lines on surfaces even in the absence of an edge that is accessible for gauging purposes.

A still further object is to provide a chalk line marking device having a shuttle for supplying chalk to the marking filament, and through which forces are applied to draw the marking string forward and then permit same to snap rearward against a receiving surface on which a chalk line is deposited.

BRIEF DESCRIPTION OF THE DRAWINGS

These objects as well as other objects of this invention shall become readily apparent after reading the following description of the accompanying drawings in which:

FIG. 3 include some portions of the handle that are not included in FIGS. 1 and 2.

DETAILED DESCRIPTION OF THE INVENTION

Figure 1:
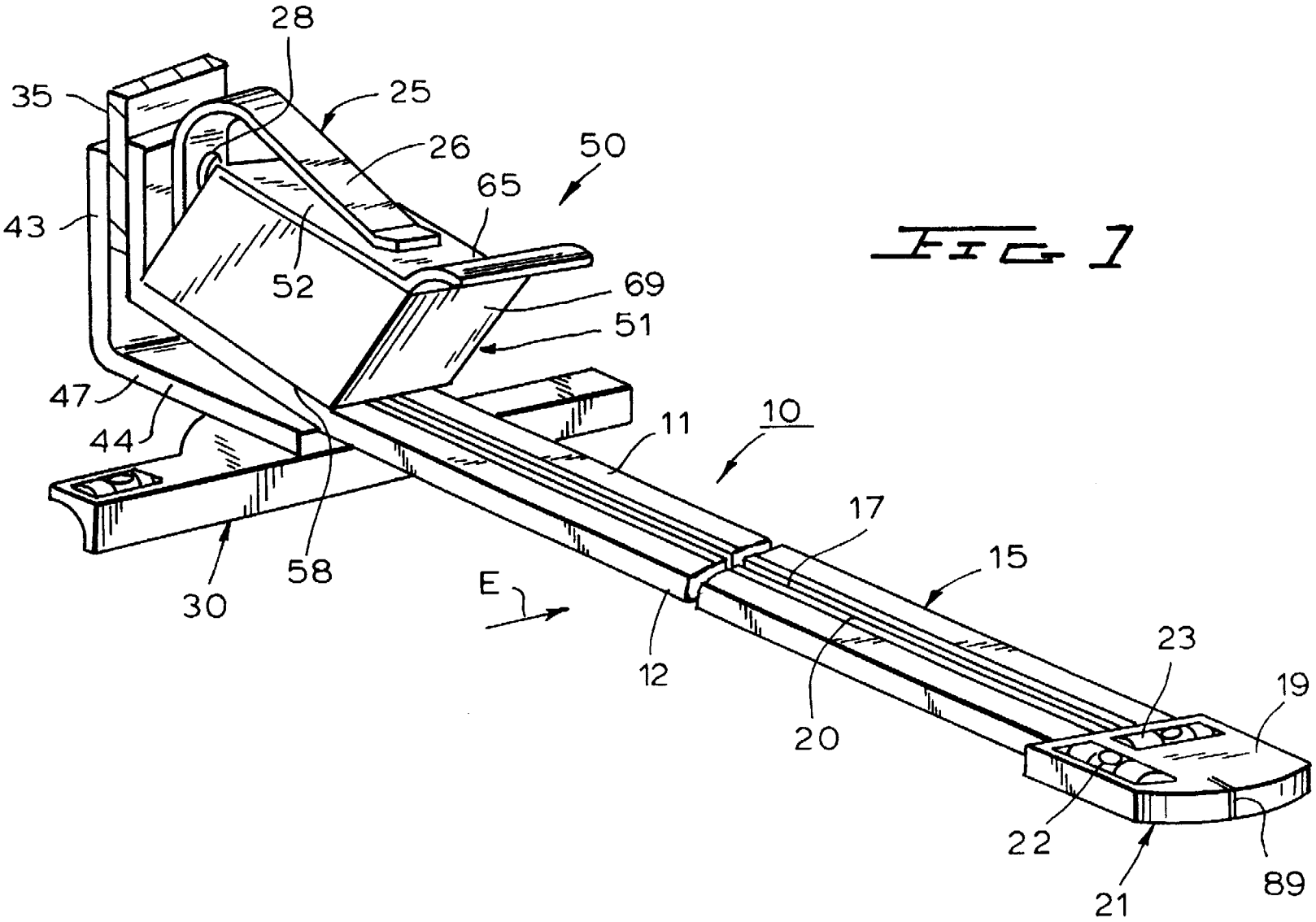
FIG. 1 is a perspective of a line marking device constructed in accordance with teachings of the instant invention with the shuttle thereof parked in its home position waiting to operate the device for marking a straight line at a desired location on a flat surface. In this FIG. 1, major portions of the device handle are broken away.

Now referring to the drawings wherein a line marking device construction in accordance with the instant invention is designated by reference numeral 10. The major elements of device 10 are elongated rod-like main body 15, a marking filament constituted by string 20, biasing spring 25, removable protractor 30, optional handle 35 and shuttle 50.

Figure 2:
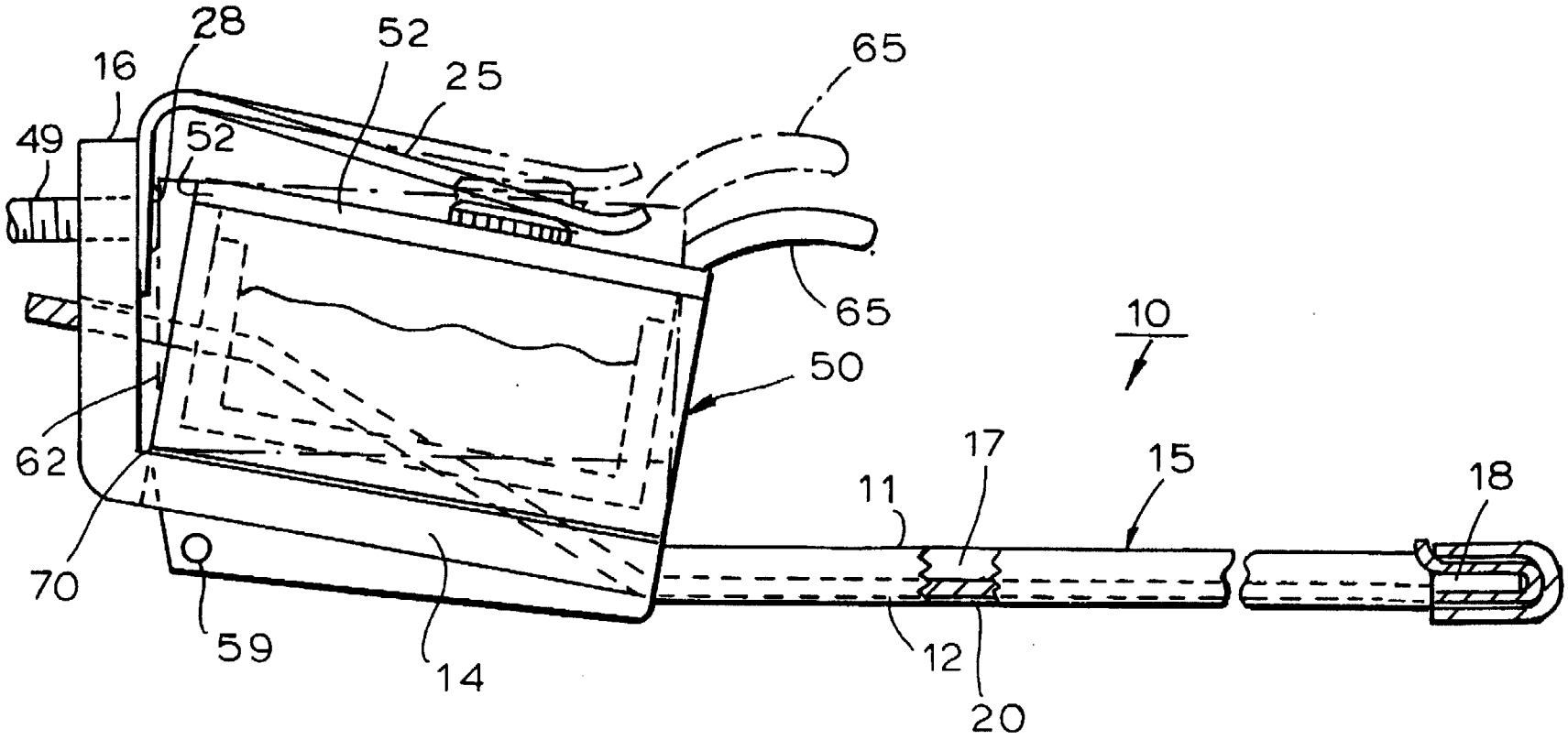
FIG. 2 is a side elevation of the marking device of FIG. 1 looking in the direction of arrow E in FIG. 1. The handle and protractor of the device are not included in this FIG. 2.
Figures 3, 3A:
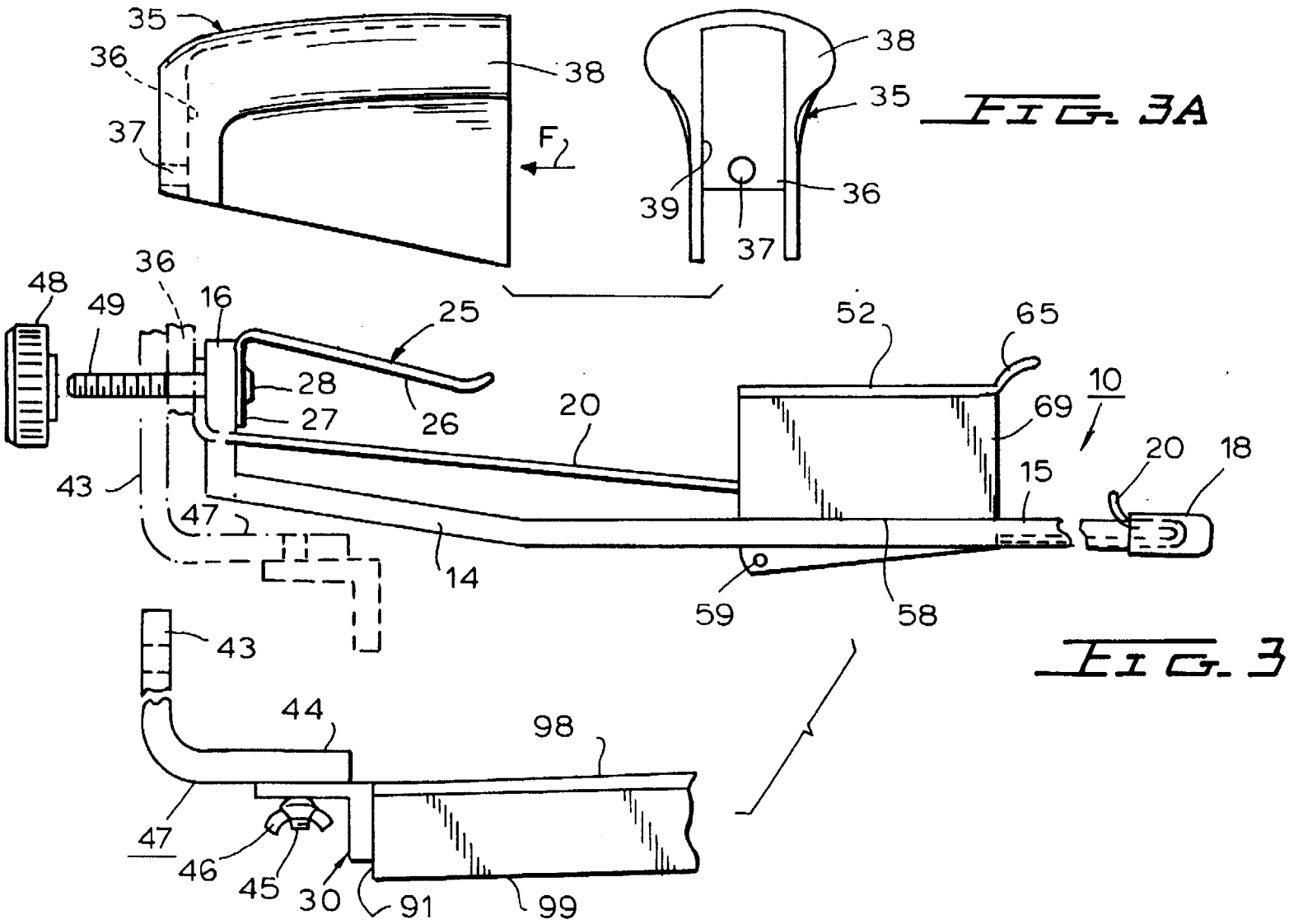
FIG. 3 is a partly exploded side elevation looking in the direction of arrow E in FIG. 1 with the shuttle removed from its home position of FIG. 2.
FIG. 3A is an end view of the handle looking in the direction of arrow F in FIG. 3.

Main body 15 includes front surface 11 and rear surface 12, the latter being intended to rest on the surface that is to be marked (i.e. front surface 98 of sheet rock 99 seen in FIG. 3). For the most part body 15 is flat. However, there is a short forwardly inclined portion 14 at the left end of body 15 as viewed in FIGS. 1–3 and at the left end of inclined portion 14 there is end tab 16 which extends forward at approximately 90° with respect to the major portion of body 15. Longitudinal guide slot extends from front surface 11 through to rear surface 12 and extends for substantially the full length of body 15. That is, slot 17 does not extend through end tab 16 but does extend through slanted section 14 and terminates shortly before end portion 18 at the right in FIGS. 2 and 3. Right end portion 18 is of reduced thickness as compared to the remainder of body 15 and extends into hollow plastic base 19 of level assembly 21. The latter also includes spirit level 22 whose elongated transparent tube is parallel to slot 17 and spirit level 23 whose elongated transparent tube is transverse to slot 17. Level assembly 21 is frictionally held on body end 18 and serves to anchor the right end of string 20 to body 15.

String 20 extends lengthwise through slot 17, lengthwise through shuttle 50, and through a clearance aperture in end tab 16, then over and partially around the body of screw 49 that is used for mounting both handle 35 and L-shaped bracket 47 to which protractor 30 is adjustably mounted. The latter is adjusted by pivoting same about screw 45 that extends rearward from the longitudinally extending leg 44 of bracket 47. Protractor 30 is held in adjusted position by tightening wing nut 46 on screw 45. Retaining nut 48, threadably engaged with screw 49, clamps the other leg 43 of bracket 47 against handle 35 to force handle portion 36 against tab 16 and by so doing clamp the left end of string 20 in place against the left surface of tab 16.

Biasing spring 25 includes elongated leaf 26 and short mounting leg 27. The latter is clamped between head 28 of screw 49 and the right surface of tab 16. Handle 35 also includes longitudinally extending hand grip 38 positioned in front of inclined body portion 14, as well as clearance aperture 37 through which screw 49 extends. Leaf 26 extends lengthwise in front of inclined body portion 14 and is disposed within cavity 39 formed in handle 35 so as to be between hand grip 38 and inclined portion 14. With shuttle 50 in its home position at the left end of body 15 as viewed in FIG. 2, spring 25 exerts a biasing force on shuttle 50 to retain same parked in its home position.

Figures 4, 4A, 4B, 4C, 4D:
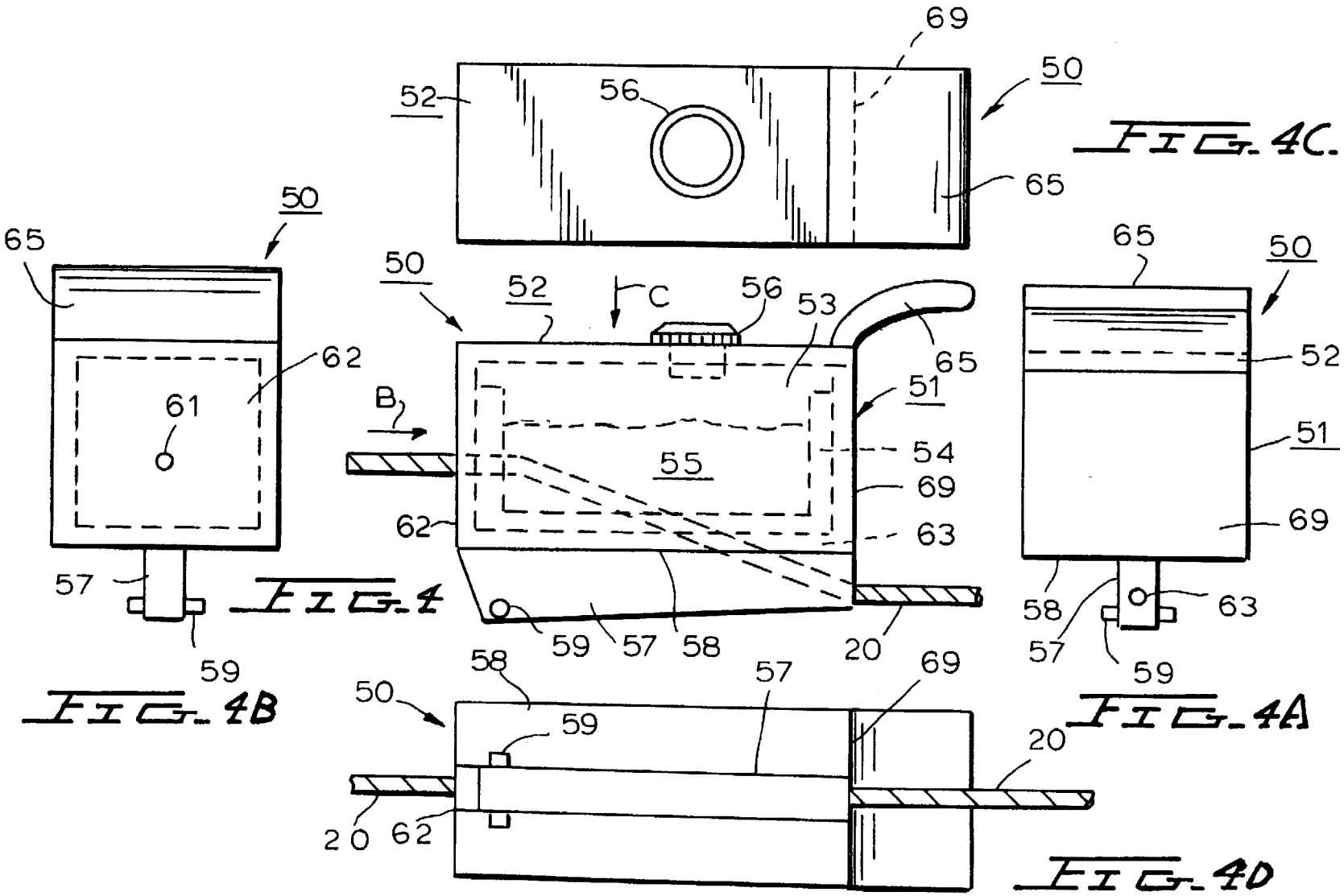
FIG. 4 is a side elevation of the shuttle.
FIGS. 4A and 4B are end views of the shuttle looking in the directions of the respective arrows A and B in FIG. 4.
FIGS. 4C and 4D are front and rear views of the shuttle looking in the directions of the respective arrows C and D in FIG. 4.

Now referring more particularly to FIGS. 4 through 4D, it is seen that shuttle 50 includes a chalk carrier constituted by rectangular container 51 having front cover member 52 which is cemented in place. A major portion of cavity 53 defined by container 51 is provided with felt liner 54 and contains a supply of powdered chalk 55. The latter is loaded into cavity 53 through an aperture in cover portion 52, which aperture is normally closed by frictionally held removable plug 56. Guide vane 57 extends lengthwise of shuttle 50, projecting rearward from rear surface 58 of container 51 at the center thereof. Slot 17 receives van 57 and cooperates therewith to guide shuttle 50 as it moves back and forth between the ends of main body 15 during rechalking of string 20. Transverse pin 59 projects beyond both sides of guide vane 57 and cooperates with rear surface 12 of body 15 to prevent separation of shuttle 50 from body 15.

String 20 extends longitudinally through shuttle 50 between aperture 61, through one end 62 of container 51 to passage 63 that extends angularly through vane 57 to the end thereof which is remote from container end 62. The boundary walls that define aperture 61 and passage 63 act as guiding formations which direct that portion of string 20 which, at a given time, is disposed within shuttle 50 to be angularly disposed with respect to body 15. Felt liner 54 and container bottom wall 58 are provided with appropriately located apertures through which string 20 extends so that when shuttle 50 is moved back and forth along body 15, relatively speaking marking string 20 moves through chalk supply 55 and in so doing picks up sufficient chalk to deposit a well defined line of chalk when string 20 is snapped against a receiving surface, such as sheet rock surface 98, that abuts rear surface 12 of body 15.

Edge 65 of cover 52 flares forward from the other end 69 of container 51. Flared edge 65 constitutes a finger engageable formation at which a forwardly directed force is applied to pivot shuttle 50 counterclockwise against the force of spring 25 about a point where the rear edge of container end 62 abuts front surface 11 of body 15. In FIG. 2 this point is designated by reference numeral 70 and the counterclockwise position for shuttle 50 is indicated by the dotted line position of cover 52 and its finger extension 65. Spring 25 normally holds shuttle 50 at its home position of FIG. 2. The position of hand grip 38 relative to shuttle extension 65 is such that a finger of the hand (not shown) engaged with handle 35 may be used for applying a forward directed force on extension 65 to pivot shuttle 50 counterclockwise and thereby draw string 15 forward.

With shuttle 50 parked at its home position of FIG. 2, counterclockwise movement thereof is limited by engagement of container end 62 with the head 28 of screw 49 as shuttle 50 is pivoted counterclockwise while at its home position, spring leaf 26 deflects counterclockwise with respect to spring foot 27. This deflection of leaf 26 increases the clockwise biasing force exerted by spring 25 against shuttle 50. Force to pivot shuttle 50 counterclockwise is a forward directed force applied to tab 65.

With shuttle 50 pivoted counterclockwise, release of tab 65 permits energy stored in biasing spring 25 to snap shuttle 50 clockwise until it seats fully on the front surface of incline 14. At this time string 20 snaps rearward through slot 17 to engage a surface, say front surface 98 of sheet rock 99, and deposit a chalk line on surface 98. By manually moving shuttle back and forth along the length of main body 15, string 20 is recharged with chalk powder from supply 55. Usually a number of clear lines may be struck before it is necessary to recharge sting 20.

To utilize edge 91 of sheet rock 99 as a reference, protractor 30 is pivoted about screw 45 to a desired angular position with respect to body 15 and is held at that position by tightening wing nut 46. Protractor 30 of body 15 is made to abut edge 91 and rear surface 12 is made to about the forward facing marking or receiving surface 98 of sheet rock 99. Then a lifting force is applied at tab 65 to pivot shuttle 50 counterclockwise and by so doing string 20 is deflected forward. Release of the forward directed force acting on extending tab 65 permits string 20 to snap rearward and strike surface 98 to thereby deposit a well defined narrow line of chalk thereon.

If a marking or receiving surface, such as a vertical wall, does not have an edge that is available for abutment by protractor 30, bracket 47 with protractor 30 thereon may be dismounted. Then rear surface 12 of body 15 is made to abut the wall or other line receiving surface (not shown), and a string snapping operation is made to occur after body 15 is oriented at a desired location. Level 23 is utilized when marking vertical lines and level 22 is utilized when marking horizontal lines. Sighting may be done through slot 17 in body 15 or by utilizing gauging line 89 on plastic cap 19.

In a suitable construction of device 10 main body 15 is approximately 30 inches long. For a construction in which body 15 is to be much longer than 30 inches it should now be apparent to those skilled in the art that body 15 may have a telescoping or hinged construction if it is desired to have a compact device for storage. Further, body 15 may be modified by eliminating central guide slot, positioning string outboard and parallel to one side of the modified body 15 and mounting shuttle 50 to move along the modified body 15 in a suitable manner.

It should also be apparent that the marking filament constituted by non-metallic string 20 may be replaced by a metallic wire or plastic strand (not shown) having suitable surface treatment for retaining a powdered marking material. The wire strand may be formed as a very small diameter tensions spring.

In place of using spring 25 to snap marking filament 20 against a line receiving surface 98, a first variation of device 10 is constructed with a filament which is pressed rearward against surface 98 by a wheel or other presser element (not shown) that is mounted on body 15 to be drawn along the length thereof, say by a flexible puller filament that is connected to the presser element and is wound on a spring loaded take-up reel (not shown) mounted on or inside of shuttle 50.

Before line marking takes place, shuttle 50 is parked in its home position at the left of FIG. 2, and the presser element is held by a detent (not shown) at the end of body 15 remote from shuttle retaining spring 25. As the user of the line marking device draws the presser to the right to extend the puller filament, a ratchet mechanism prevents the rewinding force which acts on the take-up reel from drawing the presser leftward toward shuttle 50 until a holding pawl on the ratchet is released. After body 15 is located at a selected position on the surface to be marked, the holding pawl of the ratchet is released and the spring acting on the take-up reel turns the latter to rewind the puller filament. This frees the presser from the detent and draws the presser toward shuttle 50. As the presser travels along body 15, the presser forces filament 20 against surface 98 to apply a straight line thereon.

As a second variation of device 10, the second embodiment is modified by eliminating marking filament 20 and replacing the presser by a pen or other marking instrument (not shown) that is mounted on body 15 in a position to engage surface 98 and draw a line thereon as the marking instrument is drawn from right to left with respect to FIG. 2. A shield element (not shown) mounted on body 15 is interposed between the marking instrument and surface 98 to prevent engagement between them until the marking instrument moves a very short distance from its extreme position at the right of body 15. In this second variation, shuttle 50 does not contain chalk or any other marking substance and does not need to be mounted to move from its home position at the left of FIG. 2.

In both the first and second variations the flexible puller filament that is wound on the take-up reel may be constituted by a coiled spring which upon unwinding thereof provides a biasing force for rewinding itself on the take-up reel.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A line marking device including:

an elongated main body having a rear surface adapted to face a receiving surface on which said device is to mark at least one line, and a front surface facing away from said rear surface;

a marking filament mounted to said main body with opposite ends of said marking filament being operatively secured to said main body, said marking filament extending lengthwise of said main body between longitudinally spaced first and second locations of said main body located near respective opposite ends of said main body;

a shuttle operatively connected to said marking filament and carrying a supply of a marking substance, said marking filament extending through said shuttle and said supply of marking substance carried by said shuttle;

said shuttle being mounted to travel back and forth between said first and second locations, and during said travel of said shuttle said marking filament picking up some of said marking substance;

said shuttle also being mounted to be movable forward and be snapped rearward relative to said front surface; and a spring operatively engaging said shuttle to store energy that is supplied to said spring as said shuttle is moved forward;

said marking substance that is picked up by said marking filament being transferred to a receiving surface by moving said shuttle to draw said marking filament forward and then releasing said energy that is stored in said string to snap said shuttle together with said marking filament rearward so that said marking filament engages a receiving surface disposed adjacent said rear surface and thereby transfers to such receiving surface some of said marking substance that was picked up by said marking filament to thereby mark a line on a receiving surface engaged by said marking filament.

2. A line marking device as set forth in claim 1 in which said shuttle is operatively connected to said marking filament in a manner whereby drawing said marking filament forward is achieved by applying a force to move said shuttle forward, with said force being applied through said shuttle to act on said filament.

3. A line marking device as set forth in claim 2 in which said spring is disposed to operatively engage said shuttle when said shuttle is parked in its home position which is located at said first location.

4. A line marking device as set forth in claim 3 in which said shuttle is provided with guiding formations in operative engagement with said marking filament to direct that portion of said marking filament which at any given time extends through said shuttle to be inclined rearward in a direction from said first location toward said second location.

5. A line marking device as set forth in claim 3 also including a cross-arm mounted to said main body at said first end, and being disposed rearward of said main body.

6. A line marking device as set forth in claim 5 also including an adjustable protractor, said cross-arm constituting part of said protractor, and a fastening device that removably mounts said protractor to said body.

7. A line marking device as set forth in claim 3 also including at least one level unit carried by said main body.

8. A line marking device as set forth in claim 1 in which said main body is provided with a longitudinal slot wherein that portion of said marking filament extending from said shuttle to said second location is for the most part disposed when said shuttle is at said first location, said marking filament moving out of said slot temporarily when said marking filament snaps rearward and engages a receiving surface to mark a line on said receiving surface.

9. A line marking device as set forth in claim 8 in which the shuttle includes a rearward projecting vane that extends into said slot to cooperate therewith in guiding said shuttle as said shuttle travels back and forth between said first and second locations.

10. A line marking device as set forth in claim 9 in which said vane is provided with a transverse protrusion rearward of said rear surface to cooperate therewith in limiting forward movement of said shuttle as a forward directed force is applied to said shuttle for drawing said marking filament forward.

11. A line marking device as set forth in claim 10 wherein said transverse protrusion is disposed on said vane at its end that is closer to said first location of said main body.

12. A line marking device as set forth in claim 3 also including a handle disposed at said first location, said shuttle being provided with a formation at which said forward directed force is applied to said shuttle while said spring is engaged with said shuttle;

said handle and said formation being operatively positioned such that an operator's hand grasping said handle includes a finger that is engageable with said formation to exert a forward directed force on said shuttle to draw said marking filament forward prior to snapping said marking filament rearward to contact and thereby mark a receiving surface with a line of said marking substance.

13. A line marking device as set forth in claim 1 in which said marking substance comprises powdered chalk.

14. A line marking device including:

an elongated main body having a rear surface adapted to face a receiving surface on which said device is to mark at least one line, and a front surface facing away from said rear surface;

a marking filament mounted to said main body with opposite ends of said marking filament being operatively secured to said main body, said marking filament extending lengthwise of said main body between longitudinally spaced first and second locations of said main body located near respective opposite ends of said main body;

a carrier operatively connected to said marking filament and carrying a supply of a marking substance, said marking filament extending through said carrier and said supply of marking substance carried by said carrier;

said carrier being mounted to travel back and forth between said first and second locations, and during said travel of said carrier said marking filament picking up some of said marking substance; and said marking substance that is picked up by said marking filament being transferred to a receiving surface by snapping said filament rearward to engage and thereby to mark a line on a receiving surface; and a manually operable instrumentality supported on said main body and operatively engaged with said marking filament for moving said marking filament forward and then snapping the marking filament rearward to engage and thereby deposit a line of said marking substance on a receiving surface positioned adjacent said rear surface;

said instrumentality including said carrier and a spring that is in operative engagement with and biases said carrier rearward when said carrier is at said first location.

15. A line marking device as set forth in claim 14 in which operative engagement between said spring and said carrier is broken when said carrier is moved away from said first location.

16. A line marking device as set forth in claim 14 also including a handle secured to said main body at said first location;

said instrumentality including a finger engageable formation at which a forward directed force is applied to said carrier to move said carrier forward, with said force being applied through said carrier to load said spring when said carrier is at said first position; and upon finger release of said formation, energy stored in said spring is released to snap said carrier and said marking filament forward to deposit a line of said marking substance on a receiving surface positioned adjacent said rear surface of said main body.

17. A line marking device as set forth in claim 16 wherein with said carrier at said first location said handle and said finger engageable formation being operatively positioned whereby a forward directed force may be applied to said formation by a finger on a hand that grips said handle to maintain said device in operative position for marking a line at a selected location of a receiving surface that is disposed adjacent said rear surface of said main body.

* * * * *